US005284032A

United States Patent [19]

Shima

[11] Patent Number: 5,284,032

[45] Date of Patent: Feb. 8, 1994

[54] STITCH CONTROL MECHANISM FOR A FLAT KNITTING MACHINE

[75] Inventor: Masahiro Shima, Wakayama, Japan

[73] Assignee: Shima Seiki Mfg. Ltd., Wakayama, Japan

[21] Appl. No.: 675,416

[22] Filed: Mar. 26, 1991

[30] Foreign Application Priority Data

Apr. 5, 1990 [JP] Japan ..... 2-91158

[51] Int. Cl.[5] ..... D04B 15/36

[52] U.S. Cl. ..... 66/77; 66/78; 66/54

[58] Field of Search ..... 66/77, 78, 75.1, 27, 66/37, 46, 57, 54, 60 H; 74/569

[56] References Cited

U.S. PATENT DOCUMENTS 3,116,923 1/1964 Gunther ..... 74/569
3,344,685 10/1967 Crouzet ..... 74/569
3,438,271 4/1969 Cain ..... 74/569
4,400,952 8/1983 Koike et al. ..... 66/60 H
4,774,818 10/1988 Poppa et al. ..... 66/78 X
4,996,853 3/1991 Brega ..... 66/27

FOREIGN PATENT DOCUMENTS 642296 12/1960 Italy ..... 66/77
2-251645 10/1990 Japan .

*Primary Examiner*—Clifford D. Crowder
*Assistant Examiner*—Larry D. Worrell, Jr.
*Attorney, Agent, or Firm*—Barnes, Kisselle, Raisch, Choate, Whittemore & Hulbert

[57] ABSTRACT

A stitch control mechanism for a flat knitting machine, for controlling loop size in knitting a knit fabric on a flat knitting machine. A spiral cam plate is attached to one surface of a stitch cam control cam, the spiral cam plate is held between a pair of cam rollers, and the pair of cam rollers are supported on a guide plate combined with a stitch cam and having a portion slidably fitted in a guide slot formed in a base plate.

2 Claims, 6 Drawing Sheets

STITCH CONTROL MECHANISM FOR A FLAT KNITTING MACHINE

BACKGROUND OF THE INVENTION

1. Field of the Invention

The present invention relates to a stitch control mechanism for a flat knitting machine, for controlling stitch size in knitting a knit fabric on a flat knitting machine.

2. Related Art Statement

In knitting a knit fabric, stitch size is dependent on the down stroke of the needle forming a needle loop lowered by a stitch cam. Generally, two stitch cams are disposed respectively on the opposite sides of a raising cam so as to lower the needle. The stitch cams are supported for vertical movement along the raising cam on a base plate and are moved vertically for positioning by stitch cam moving means. As shown in FIG. 5, a stitch cam 51 is supported on a guide plate 54 having a portion slidably fitted in a slot 53 formed in a base plate 52. A stitch cam positioning cam 57 is supported on the output shaft 56 of a motor 55. A cam roller 58 supported on the guide plate 54 at the upper end of the same is biased toward the stitch cam positioning cam 57 by the contractive force of a spring 59. Another cam roller 60 is supported on the lower end of the guide plate 54. The stitch cam 51 is raised when a stitch cam raising cam plate 61 engages the cam roller 60, and the stitch cam 51 is lowered and the cam roller 58 is brought into contact with the stitch cam positioning cam 57 when the stitch cam raising plate 61 separates from the cam roller 60. The stitch cam positioning cam 57 is turned to raise or lower the stitch cam 51 for positioning through the cam roller 58 and the guide plate 54.

Since the cam roller, which moves together with the stitch cam, and the stitch cam positioning cam are engaged by the contractive force of the spring, the displacement of the cam roller is liable to fall behind the turning motion of the stitch cam positioning cam when the knitting machine operates at a high knitting speed.

A stitch control mechanism shown in FIG. 6 incorporates improvements to overcome such a disadvantage. Similarly to the stitch control mechanism shown in FIG. 5, this stitch control mechanism supports a stitch cam 71 on a guide plate 74 having a portion slidably fitted in a slot 73 formed in a guide plate 74. A cam roller 75 pivotally supported on the guide plate 74 engages a stitch cam control lever 76 supported for swing motion on a shaft 77. A cam roller 78 is supported pivotally on the stitch cam control lever 76 in the middle portion of the same and the cam roller 78 is fitted in the spiral cam groove 79 of a stitch cam control cam 80. The stitch cam control cam 80 is fixed to the output shaft 82 of a motor 81. The stitch cam control cam 80 is turned by the motor 81 and, consequently, the stitch cam control lever 76 swings to move the guide plate 74 supporting the cam roller 75 so that the stitch cam 71 is raised or lowered. A small clearance must be formed between the cam roller 78 supported on the stitch cam control lever 76 and the side surface of the spiral cam groove 79 of the stitch cam control cam 80 to allow the cam roller 78 to move along the spiral cam groove 79. Accordingly, the rotation of the motor 81, hence the rotation of the stitch cam control cam 80, may not accurately be transmitted in a linear motion to the stitch cam 71.

Since the spring of the former conventional stitch control mechanism biases the stitch cam continuously downward as stated above, the stitch cam control cam and the cam roller supported on the guide plate supporting the stitch cam must be separated from each other for every loop size adjustment or the motor must be of a large output capacity. Accordingly, the carriage is formed inevitably in a comparatively large size and hence a comparatively large driving mechanism is required.

Furthermore, the spring for biasing the stitch cam downward, the cam plate for separating the cam roller provided on the guide plate supporting the stitch cam from the stitch cam control cam, and the mechanism for operating those components, which are essential to this conventional stitch control mechanism, increase the size and weight of the stitch control mechanism, which is an impediment to the enhancement of the knitting speed of the knitting machine. Still further, since a clearance is formed between the stitch cam control cam and the cam roller, i.e., a stitch cam moving member, the cam roller is unable to follow the movement of the stitch cam control cam without delay.

OBJECT AND SUMMARY OF THE INVENTION

In view of the foregoing problems, it is an object of the present invention to provide a stitch cam moving mechanism having a stitch cam control cam and capable of accurately converting the rotation of the stitch cam control cam into the linear movement of the stitch cam. In the stitch control mechanism of the present invention, a spiral cam plate is attached to one surface of a stitch cam control cam, the spiral cam plate is held between a pair of cam rollers, and the pair of cam rollers are supported on a guide plate combined with a stitch cam and having a portion slidably fitted in a guide slot formed in a base plate.

According to the present invention, one of the cam rollers supported on the stitch cam holding plate formed integrally with the stitch cam is pressed against the stitch cam control cam plate by a spring to nip the stitch cam control cam plate between the cam rollers. When a motor is actuated to turn the stitch cam control cam plate fixed to the output shaft of the motor, the cam rollers are displaced by the stitch cam control cam plate to shift the stitch cam to change the loop size. Since the cam plate is gripped between the cam rollers and there is not any clearance between the cam plate and the cam rollers, the rotation of the cam plate can be transmitted to the stitch cam through the cam rollers without any lost motion.

DETAILED DESCRIPTION OF THE PREFERRED EMBODIMENT

A stitch control mechanism in a preferred embodiment according to the present invention will be described hereinafter with reference to the accompanying drawings.

Figure 1:
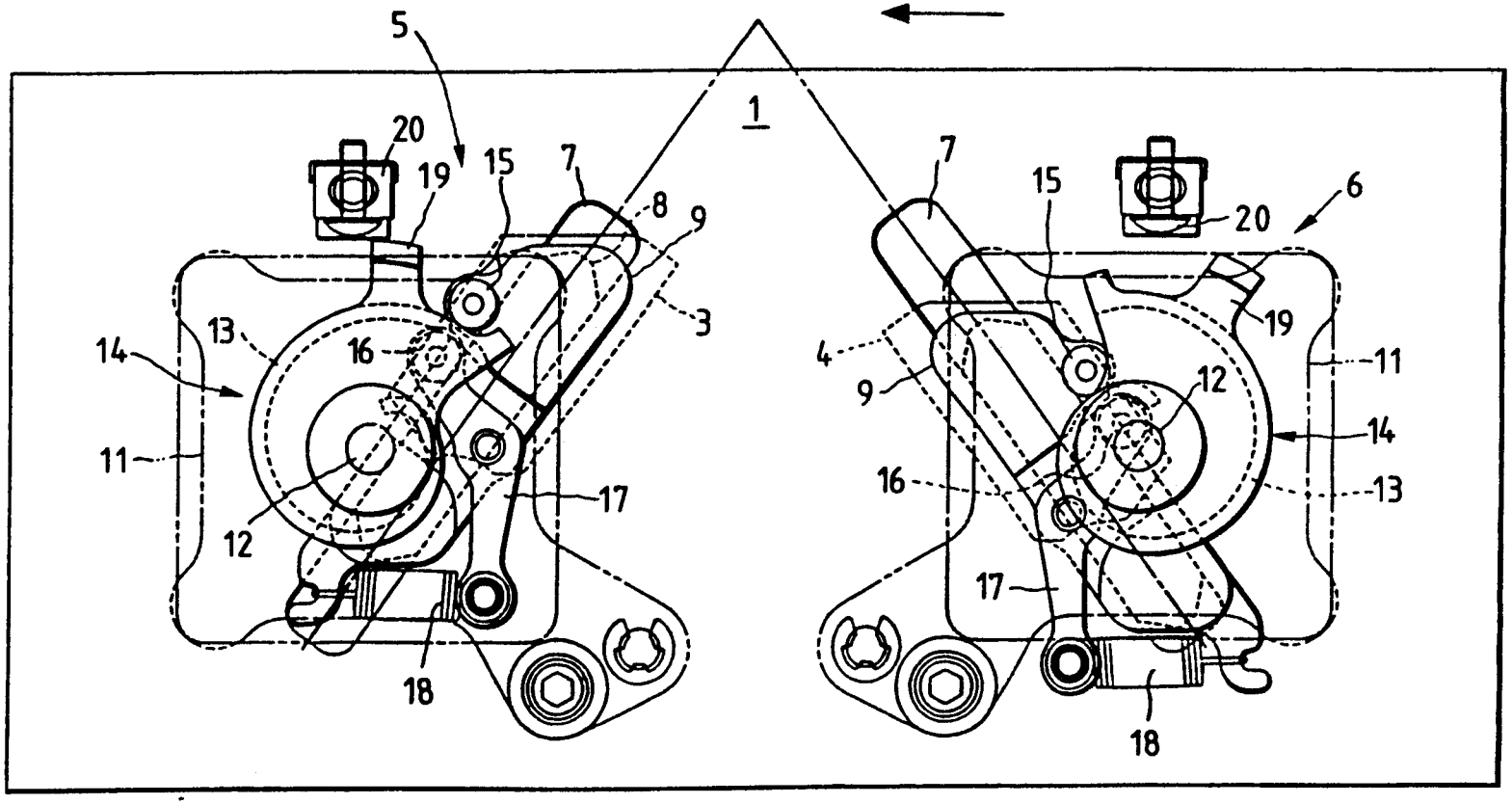
FIG. 1 is a top plan view of the base plate of a carriage incorporating a stitch control mechanism in a preferred embodiment according to the present invention.
Figure 2:
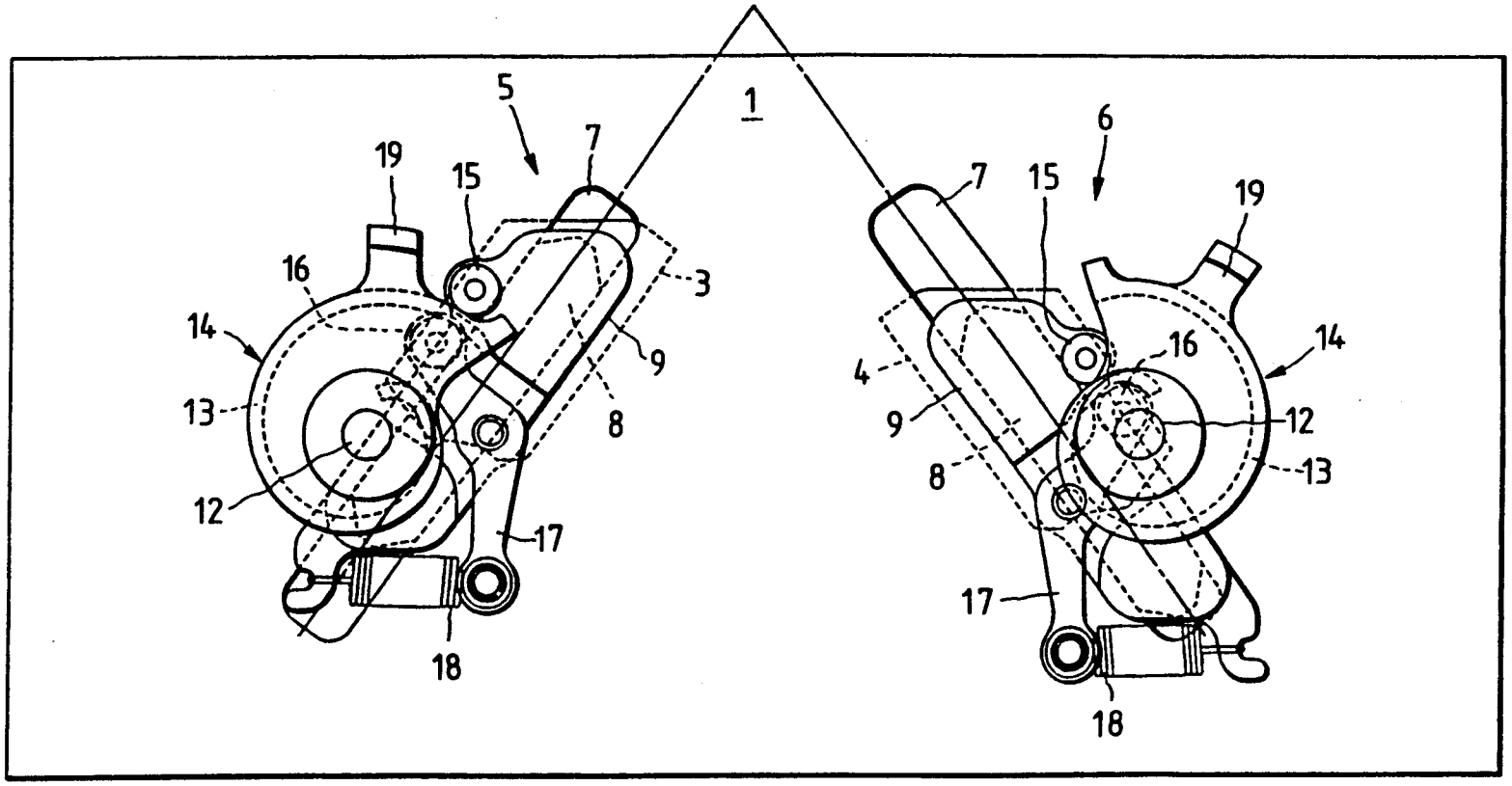
FIG. 2 is a top plan view of the base plate shown in FIG. 1, in which motor bases and stitch cam control motors mounted on the motor bases are removed.
Figure 3:
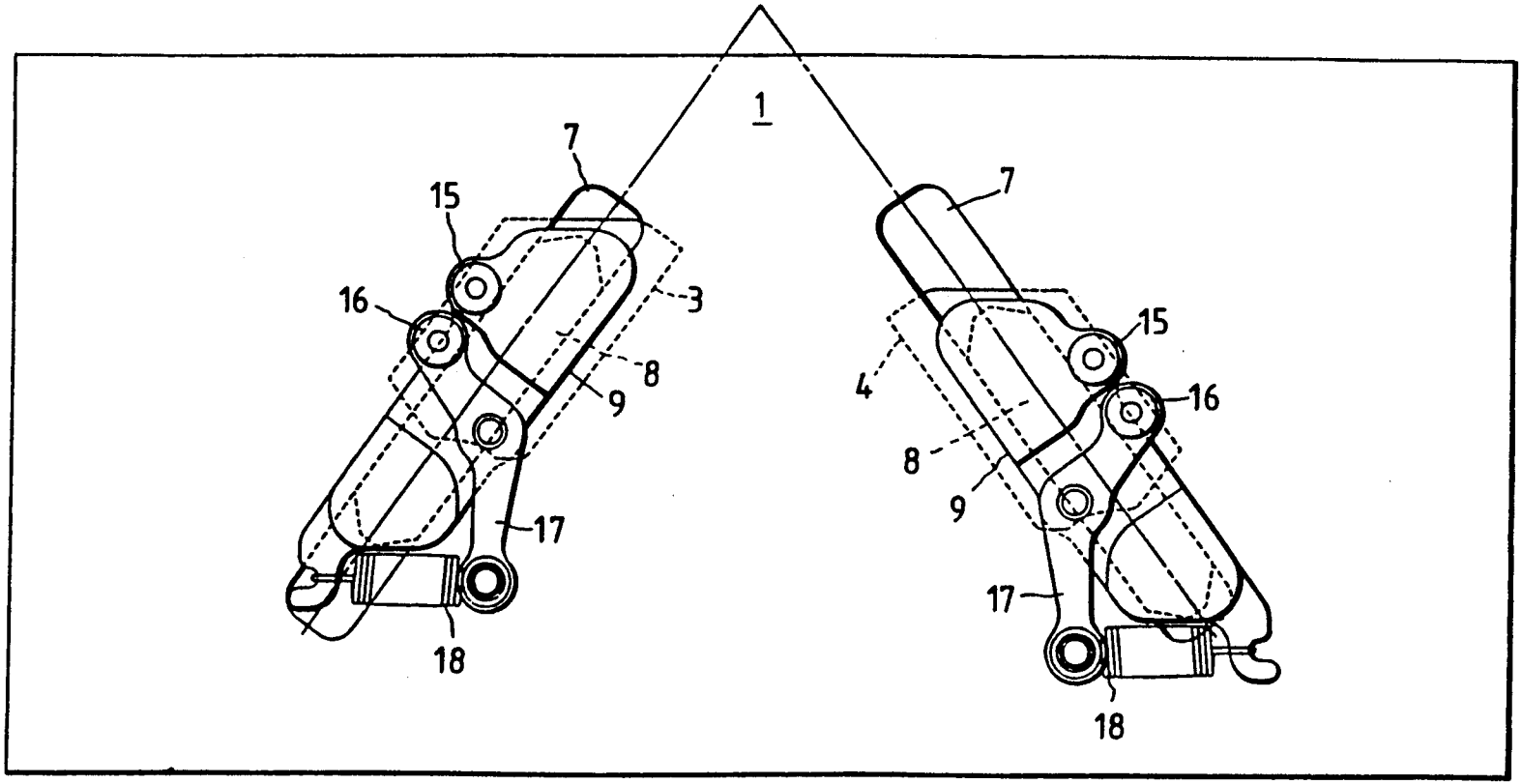
FIG. 3 is a top plan view, similar to FIG. 2, in which stitch cam control cams are removed.
Figure 4:
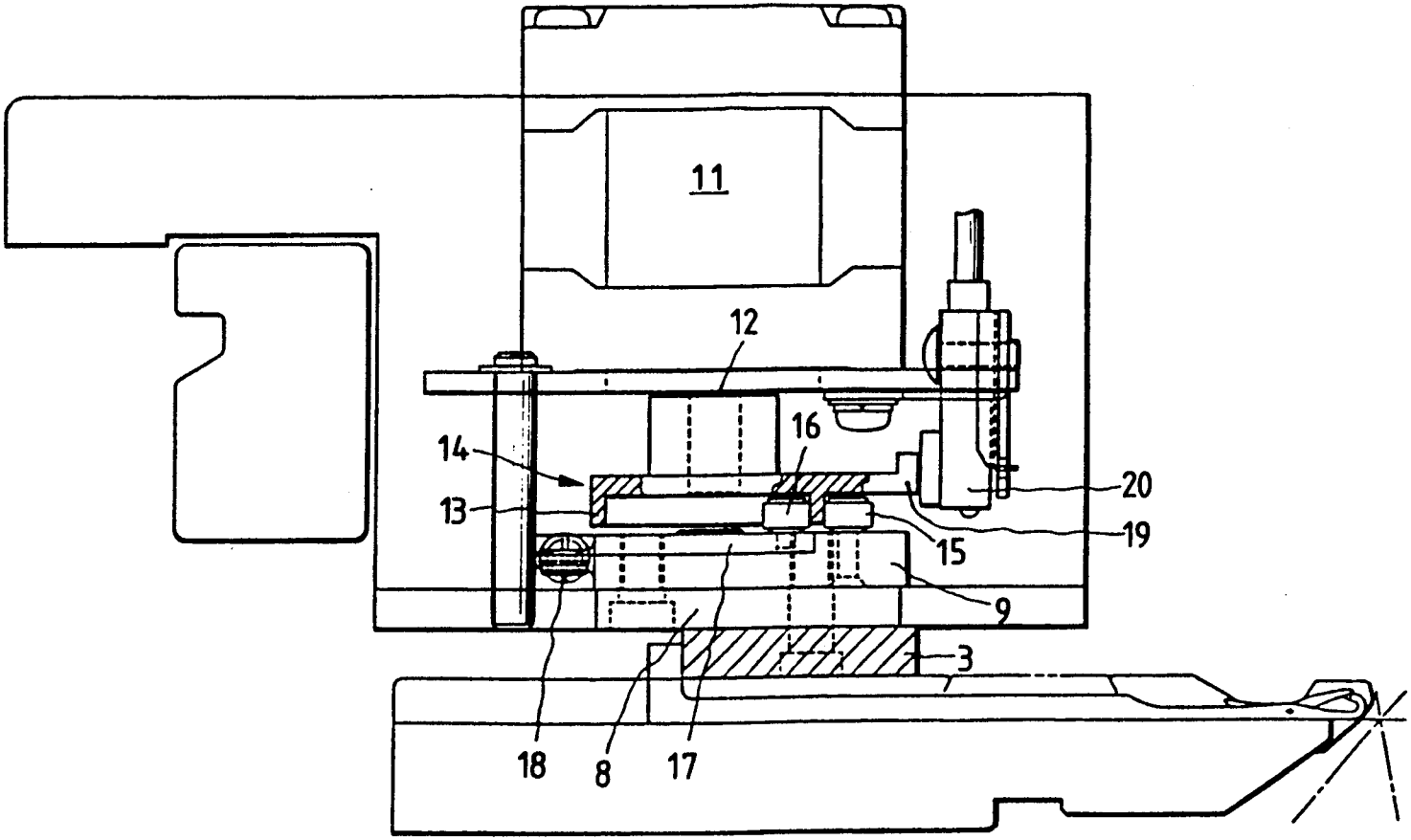
FIG. 4 is a partially cutaway side view of the stitch control mechanism of FIG. 1.
Figure 5:
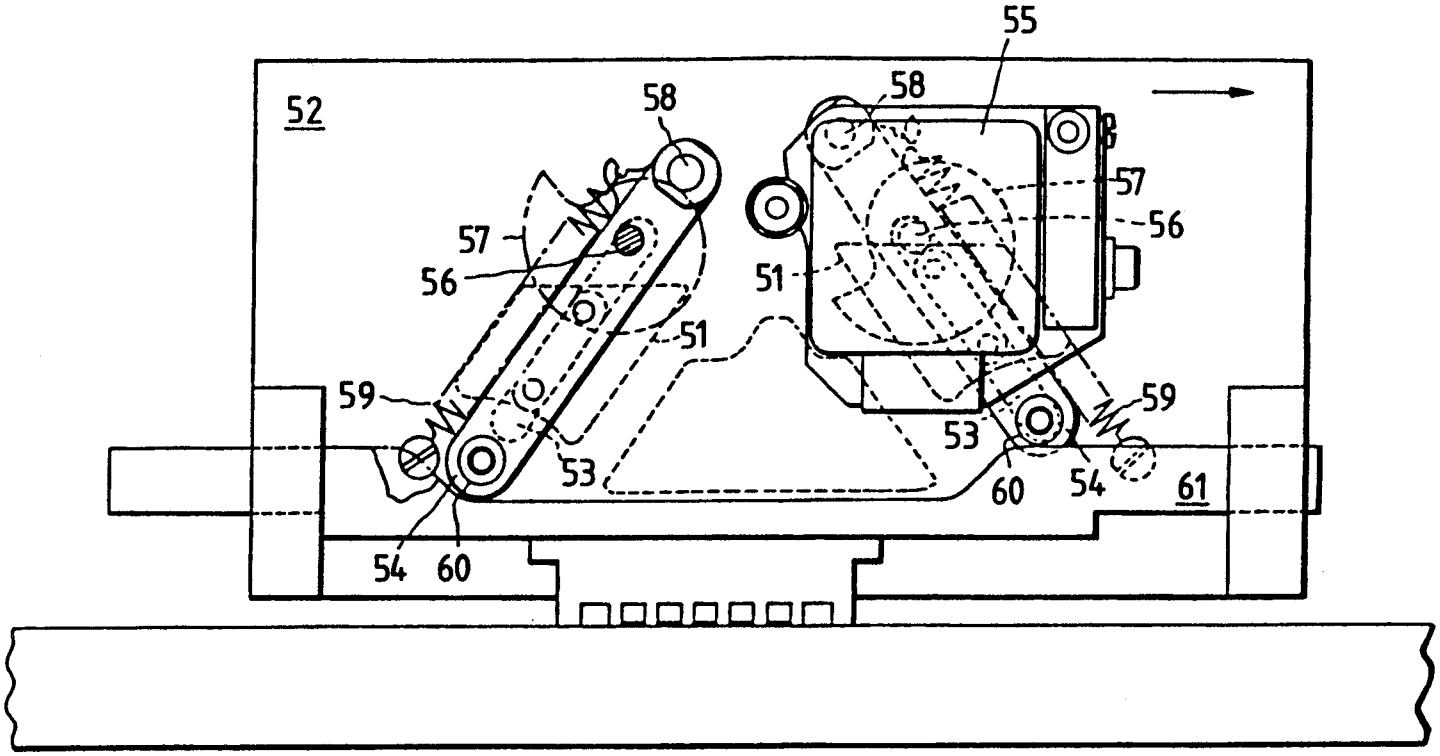
FIGS. 5 and 6 are top plan views of the base plates of carriages incorporating conventional stitch control mechanisms, respectively.
Figure 6:
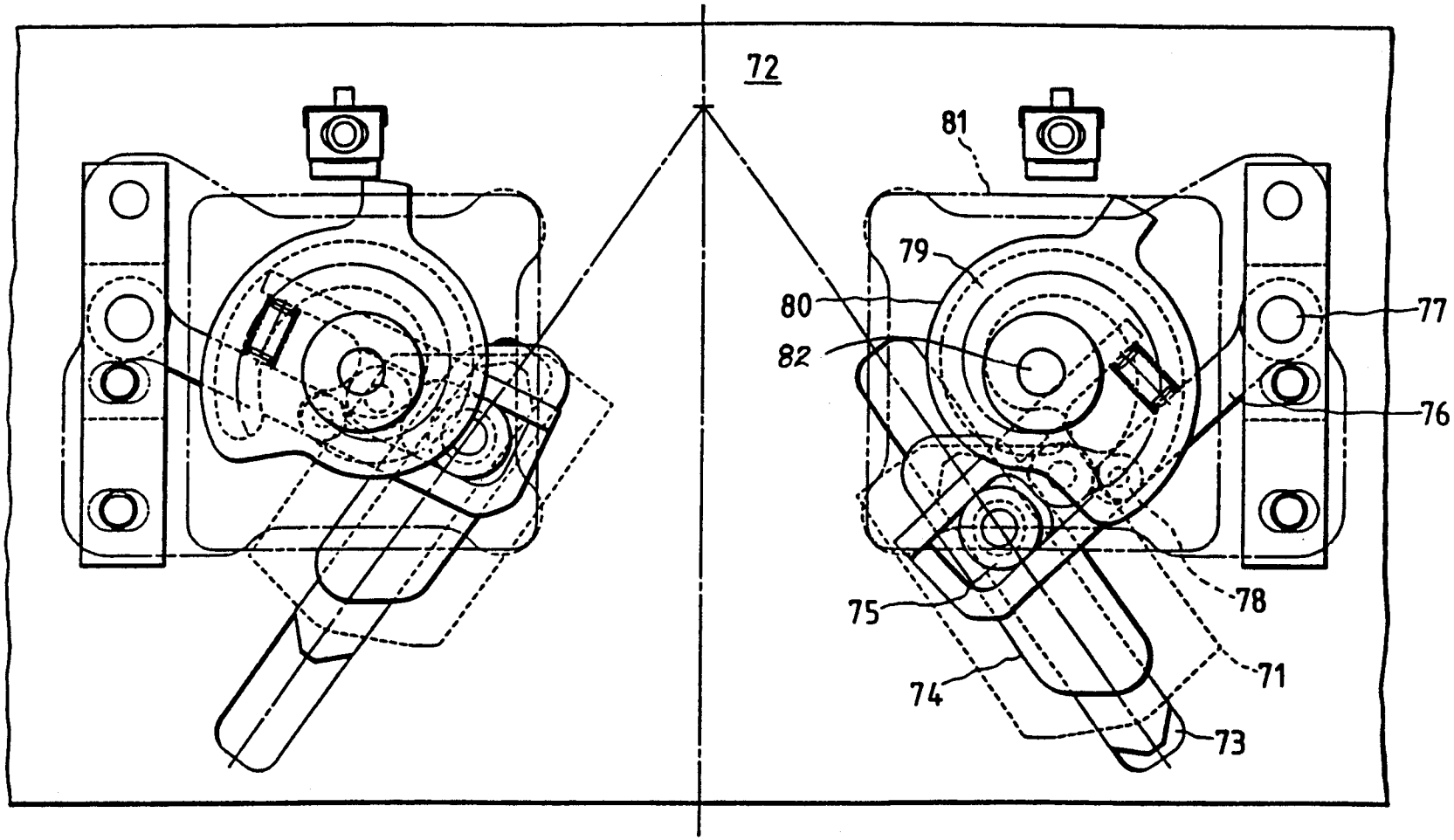

FIG. 1 is a top plan view of the base plate 1 of a carriage. Arranged on the base plate 1 are a pair of stitch cams 3 and 4 disposed respectively on the opposite sides of a raising cam, not shown, and stitch cam control units 5 and 6 for adjusting the respective positions of the stitch cams 3 and 4. The stitch cam control units 5 and 6 are in a mirror-image relation to each other and therefore only the stitch cam control unit 5 will be described.

A slot 7 is formed in the base plate 1 to guide the stitch cam 3 for oblique movement. A sliding member 8 is fitted for sliding movement in the slot 7. The stitch cam 3 and holding plate 9 are fixed respectively to the lower and upper surfaces of the sliding member 8. A stitch cam control motor 11 is mounted on a motor base, not shown, provided on the upper surface of the base plate 1. A stitch cam control cam 14 having a spiral cam strip 13 is fixed to the output shaft 12 of the stitch cam control motor 11. The spiral cam strip 13 is held between cam rollers 15 and 16 provided on the stitch cam holding plate 9. The cam roller 15 is directly supported on the stitch cam holding plate 9, while the cam roller 16 is supported pivotally on one end of a swing arm 17 pivotally supported for swing motion on the stitch cam holding plate 9. An extension spring 18 is extended between the other end of the swing arm 17 and the stitch cam holding plate 9 so as to press the cam roller 16 against the spiral cam strip 13. The stitch cam control cam 14 has a projection 19. A proximity sensor 20 provided on the base plate 1 detects the projection 19 upon the arrival of the stitch cam control cam 14 at its zero position to stop the stitch cam control motor 11. When the stitch cam control cam 14 is at the zero position, the cam rollers 15 and 16 nip the spiral cam strip 13 therebetween at a position at a maximum distance away from the shaft 12 holding the stitch cam control cam 14, and the stitch cam 3 is positioned at the highest position.

Suppose that one course of a knit fabric 1 has been stitched and the carriage has been reversed for travel to the left, as viewed in FIG. 1, to start stitching the next new course. Before starting the carriage for travel to the left for stitching a new course, the stitch cam control units 5 and 6 are operated to raise the stitch cam 3 to the highest position and to lower the stitch cam 4 to a position for forming loops of a predetermined loop size.

In raising the stitch cam 3, a signal is given to the stitch cam control motor 11 of the preceding stitch cam control unit 5 to turn the stitch cam control cam 14 counterclockwise and, upon the detection of the projection 19 of the stitch cam control cam 14 by the proximity sensor 20, the motor 11 is stopped. In this state, the cam rollers 15 and 16 nipping the spiral cam strip 13 is at the maximum distance from the output shaft 12 of the motor 11 and the stitch cam holding plate 9 is raised to its highest position. Consequently, the stitch cam 3 fixed to the sliding member 8 fixed to the stitch cam holding plate 9 is raised to its highest position.

On the other hand, the succeeding stitch cam control unit 6, in which the stitch cam control cam 14 has been at an angular position where the projection 19 is positioned opposite to the proximity sensor 20 and the stitch cam holding plate 9 is at its highest position until the completion of stitching the previous course, must lower the stitch cam 4 to a desired position corresponding to a predetermined loop size. The angle of rotation of the output shaft 12 of the motor 11 necessary for lowering the stitch cam 4 to the desired position is determined by the number of pulses to be applied to the motor 11. In the stitch cam control unit 6 on the right-hand side in FIG. 1, the stitch cam control cam 14 is turned by the stitch cam control motor 11 to move the stitch cam holding plate 9 through the cam rollers 15 and 16 engaging the spiral cam strip 13 of the stitch cam control cam 14 to its lowest position together with the stitch cam 4.

Suppose that the downward movement of the stitch cam 3 is obstructed by some cause during the downward movement of the stitch cam 3. The stitch cam control motor 11 continues its rotation to rotate the stitch cam control cam 14 continuously so that the cam roller 16 is pressed continuously by the spiral cam strip 13 even if the downward movement of the stitch cam 3 is obstructed. Then, a safety action is exercised. Although the cam roller 16 in contact with the inner surface of the spiral cam strip 13 is pressed by the spiral cam strip 13 as the working radius of the spiral cam strip 13 decreases gradually, the stitch cam holding plate 9 will not move downward. Then, the swing arm 17 is turned counterclockwise against the tension of the spring 18 through the cam roller 16 by the spiral cam plate 13 to prevent inducing excessive stress in the component parts.

A stitch control mechanism in accordance with the present invention employs a pair of cam rollers supported on a stitch cam holding plate so as to nip the spiral cam strip of a stitch cam control cam continuously in shifting a stitch cam. Accordingly, the rotating stitch cam control cam and the linearly moving stitch cam holding plate are interlocked closely without allowing any lost motion between the stitch cam control cam and the stitch cam holding plate so that the stitch cam can accurately be shifted in response to the rotation of the stitch cam control cam.

What is claimed is:

1. A stitch control mechanism for a flat knitting machine comprising:

a carriage with a base plate having a slot therein;

a control cam having a periphery and two sides and rotatably mounted on the base plate about an axis;

a spiral cam on one side of said control cam having two opposed surfaces parallel to the rotational axis of said control cam extending about a varying radius to define a spiral path;

a stitch cam having a member received in the slot of the base plate so that said stitch cam is guided for reciprocal movement in the slot of the base plate;

a stitch cam holding plate supported on said stitch cam for reciprocal movement therewith;

a pair of cam rollers supported on said stitch cam holding plate, each said cam roller engaging a surface of said stitch cam, a swing arm pivotally mounted to said stitch cam holding plate;

a first cam roller of said pair of cam rollers being directly supported on said stitch cam holding plate and a second cam roller of said pair of cam rollers being supported at one end of said swing arm; and a spring connected between said stitch cam holding plate and the other end of said swing arm to bias said second cam roller against said spiral cam, wherein said spiral cam extends between said cam rollers such that as said control cam rotates, said stitch cam holding plate moves in a direction perpendicular to rotational axis of said control cam by the engagement of said rollers with said spiral cam strip.

2. A stitch control mechanism as in claim 1 further comprising a projection on the periphery of said control cam;

a control motor having an output shaft for driving said control cam; and a proximity sensor for detecting said projection at a selected position and stopping said control motor.

* * * * *